US010926331B2

(12) United States Patent
Yan et al.

(10) Patent No.: US 10,926,331 B2
(45) Date of Patent: Feb. 23, 2021

(54) METHOD FOR REINFORCING METAL MATERIAL BY MEANS OF GRAPHENE

(71) Applicant: AVIC BEIJING INSTITUTE OF AERONAUTICAL MATERIALS, Beijing (CN)

(72) Inventors: Shaojiu Yan, Beijing (CN); Cheng Yang, Beijing (CN); Qihu Hong, Beijing (CN); Dabo Liu, Beijing (CN); Shenglong Dai, Beijing (CN); Zuoming Lin, Beijing (CN)

(73) Assignee: AVIC BEIJING INSTITUTE OF AERONAUTICAL MATERIALS, Beijing (CN)

( * ) Notice: Subject to any disclaimer, the term of this patent is extended or adjusted under 35 U.S.C. 154(b) by 543 days.

(21) Appl. No.: 15/281,949

(22) Filed: Sep. 30, 2016

(65) Prior Publication Data

US 2017/0014908 A1 Jan. 19, 2017

Related U.S. Application Data

(63) Continuation of application No. PCT/CN2014/075219, filed on Apr. 11, 2014.

(30) Foreign Application Priority Data

Apr. 4, 2014 (CN) ..... 201410136468.3

(51) Int. Cl.

| | |
|---|---|
| ***B22F 7/00*** | (2006.01) |
| ***C22C 26/00*** | (2006.01) |
| ***B22F 1/00*** | (2006.01) |
| ***B22F 3/15*** | (2006.01) |
| ***B22F 3/20*** | (2006.01) |
| ***B22F 9/04*** | (2006.01) |
| ***C22C 1/10*** | (2006.01) |

(52) U.S. Cl.

CPC ..... *B22F 7/008* (2013.01); *B22F 1/0003* (2013.01); *B22F 3/15* (2013.01); *B22F 3/20* (2013.01); *B22F 9/04* (2013.01); *C22C 1/1084* (2013.01); *C22C 26/00* (2013.01); *B22F 2003/208* (2013.01); *B22F 2009/041* (2013.01); *B22F 2009/043* (2013.01); *B22F 2301/052* (2013.01); *B22F 2302/40* (2013.01); *B22F 2998/10* (2013.01)

(58) Field of Classification Search

CPC .... B22F 7/008; B22F 9/04; B22F 3/20; B22F 3/15; B22F 1/0003; B22F 2009/043; B22F 2302/40; B22F 2301/052; B22F 2009/041; B22F 2003/208; B22F 2998/10; C22C 26/00; C22C 1/1084

See application file for complete search history.

(56) References Cited

U.S. PATENT DOCUMENTS 9,643,144 B2 * 5/2017 Xu ..... B22F 1/02
2007/0092855 A1 * 4/2007 Sernetz ..... A61C 13/0003 433/218

FOREIGN PATENT DOCUMENTS

| | | | |
|---|---|---|---|
| CN | 101850422 A | | 10/2010 |
| CN | 102329976 A | * | 1/2012 |
| CN | 102719719 A | | 10/2012 |
| CN | 102581504 B | * | 7/2014 |
| KR | 20130110243 A | * | 10/2013 |

OTHER PUBLICATIONS

Jingyue Wang, Zhiqiang Li, Genlian Fan, Huanhuan Pan, Zhixin Chen, Di Zhang, Reinforcement with graphene nanosheets in aluminum matrix compositesScripta Materialia, vol. 66, Issue 8, Apr. 2012, pp. 594-597, (Year: 2012).*

Oberg, Erik; Jones, Franklin D.; Horton, Holbrook L.; Ryffel, Henry H. (2000),&nsbp;Machinery's Handbook&nsbp;(26th ed.), New York: Industrial Press,&nsbp;ISBN&nsbp;0-8311-2635-3.pp. 1348-1349 (Year: 2000).*

H.V. Atkinson and S. Davies, Fundamental Aspects of Hot Isostatic Pressing: An Overview,&nsbp;Metall. Mater. Trans. A,&nsbp; vol. 31A, Dec. 2000, p. 2981-3000 table 1 (Year: 2000).*

Bartolucci et al., "Graphene-aluminum nanoconnposites," Mat. Sci. & Eng., A 528 (2011) pp. 7933-7937 (Year: 2011).*

Bastwros et al. ("Fabrication of Graphene Reinforced Aluminum Composite by Semi-Solid Processing," Proceedings of the ASME 2013 Int'l. Mechanical Engineering Congress and Exposition, Nov. 15-21, San Diego, CA, USA) (Year: 2013).*

Bastwros, et al., "Effect of ball milling on graphene reinforced AL6061 composite fabricated by semi-solid sintering," Composites: Part B 60 (2014), pp. 111-118. (Year: 2014).*

International Search Report issued in International Application No. PCT/CN2014/075219 dated Jan. 16, 2015 (2 pages).

* cited by examiner

*Primary Examiner* — John A Hevey

(74) *Attorney, Agent, or Firm* — Osha Bergman Watanabe & Burton LLP

(57) ABSTRACT

A method of reinforcing a metallic material includes adding graphene to an alcohol solution; subjecting the alcohol solution containing graphene to sonication; mixing a metal powder with the alcohol solution containing graphene; milling the metal powder and alcohol solution containing graphene mixture; drying the metal powder and alcohol solution containing graphene mixture to form a composite powder; subjecting the composite powder to a densification process followed by a hot isostatic pressing treatment to form a composite material; and molding the composite material by hot extrusion.

6 Claims, No Drawings

METHOD FOR REINFORCING METAL MATERIAL BY MEANS OF GRAPHENE

TECHNICAL FIELD

The present invention is a method of reinforcing the metallic material through graphene, belonging to the technical field of composite materials.

TECHNICAL BACKGROUND

Graphene is a new type of 2D nanomaterial, whose tension strength reaches 1.01 Tpa, 100 times of that of steel while the density is only steel's 1/5. Since the traditional method can hardly promote the strength of metal material, graphene became another significant orientation for reinforcing the metal materials. Graphene is composed of one-molecule-thick planar sheet of sp2 bonded carbon molecules, which packed into a honeycomb network, ranging in length between 20 μm~50 μm. Up-to-date, there are two main methods, physical and chemical, for synthesizing graphene and the latter one stands out as the primary strategy that can yield large amounts of chemically modified graphene. Due to the small density, it can improve the metal material strength while reducing the density of the material. Meanwhile Graphene also has ultra-high electron mobility (200000 $cm^2/V \cdot S$), electrical conductivity, thermal conductivity (5000 W/m·K), Young's modulus (1100 GPa), and other excellent performance, and therefore with regards graphene composite to aluminum, titanium, magnesium and other metal materials, it's expected to get lightweight, high strength materials with both electrical and thermal conductivity and other features integrated.

Compared with carbon nanotubes, graphene has higher intensity, specific surface area and lower production costs, it was predicted that graphene membranes may become the next generation of electronic materials, and is expected to replace the carbon nanotube composites as the best future fillers and reinforcements. Thus, graphene-based composite materials research and development is an important direction toward practical application of graphene.

Due to the huge differences of the nature between the graphene and the metal material, it is difficult to mold graphene and metal matrix composite. Few research relating graphene reinforcing metallic matrix composite are reported and how to precisely and homogenously add graphene into the metallic matrix to develop the reinforcing effect is a tough issue for many researchers.

The existing methods are usually by mixing graphene oxide and metal powder and via reducing treatment to get pure graphene, then through cold pressing, sintering accompanied by hot extrusion or hot pressing procedure to prepare metallic matrix composite. The shortages of the above methods are as following: (1) the graphene is obtained by reducing treatment of graphene oxide, and it's difficult to control the amount of addition; (2) for the easily oxidized metal powder, procedures like cold pressing, sinter cannot totally remove the oxygen that oxidizes the surface of the metal particles to form oxide film which is not good for the combination of graphene and metal particles, eventually affect the performance of the composite.

SUMMARY

The present invention provides a method for reinforcing metal materials via graphene aimed at solving the shortages of the existing technical conditions. First, prepare monodisperse graphene solution by ultrasonic oscillation, mix the solution with metal powder and mill to embedded graphene onto the surface of the metal particles. Then by densification powder metallurgy process, and finally via hot extrusion process to obtain graphene reinforced metal bar or sheet.

The specific procedures of this method are:

(1) 5 g graphene was added to 495 ml of alcohol solution, smash graphene solution prepared using ultrasonic cells for over 30 minutes.

(2) Mix 1000 g metal powder with 100-2000 ml graphene solution in step (1) uniformly and loaded into milling pot, then mill for over 24 h.

By milling, the flaky graphene was embedded onto the surface of metal particles and form better interaction to make more evenly mixing of graphene and metal powder. The milling process further refines the grain size and enhances the property.

(3) Take out the mixture after milling and load into a beaker and place in the oven to dry to get the composite powder.

(4) Put the powder into sheath and oscillate to increase the apparent density.

(5) Vacuumize and heat the sheath to remove the steam and mixed gas in order to prevent the oxidation of metal powder which is difficult to molding, seal the sheath when the vacuum degree reaches $1.0\times10^{-3}$ Pa. The sheath may be sealed by any method known in the art, for example, the sheath may be sealed by welding.

(6) Hot isostatic pressing treatment applied on the sheath to model and form the close-grained graphene reinforced composite material.

(7) Molding the composite by hot extrusion to form graphene reinforced metal bar or plate.

The advantages and benefits are:

First, in most researches, the additive is graphene oxide and reducing treatment procedure is necessary, it's difficult to control the amount of additives precisely. In this invention, pure graphene was added directly, which is in favor of controlling the amount.

Second, in this method monodispersed graphene homogeneous solution was prepared via ultrasonic oscillations. Monodispersed graphene homogeneous solution is easy to composite with metal powder.

Third, in this invention graphene and metal powder are composited via milling and the flaky graphene was embedded onto the surface of metal particles to form better interaction. At the same time, the high speed milling process make graphene mixed more homogenously and the dispersity of graphene can be guaranteed.

Fourth, by hot extruding process graphene further dispersed and form oriented texture which is helpful to develop the reinforcing effect.

Fifth, put the powder into sheath, vacuumize and heat the sheath to remove the steam and mixed gas to inhibit the oxide film on metal particles. The graphene and metal particles can combine well.

Sixth, the process is simple and easy to implement mass larger graphene reinforced material preparation, lower the costing. This method has excellent application prospect.

DETAILED DESCRIPTION

The following examples will combine the technical aspect of the present invention and describe in detail.

Example 1

The procedure of preparing graphene reinforced metal material are as follows:

(1) 5 g graphene was added to 495 ml of alcohol solution, smash graphene solution prepared using ultrasonic cells for 30 minutes.

(2) 1000 g aluminum powder mix with 500-1000 ml graphene solution in step (1) uniformly and loaded into milling pot, add certain amount of ethyl alcohol to the pot and make the volume of solution to ⅔ of the pot. The whole solution was milled for over 24 h.

(3) Take out the mixture after milling and load into a beaker and place in the oven to dry to get the composite powder.

(4) Put the powder into pure aluminum sheath with size of Φ70 mm×80 mm and oscillate, the apparent density is not lower than 1.6 g/cm3.

(5) Vacuumize and heat the sheath at 480° C., seal the sheath when the vacuum degree reaches $1.0\times10^{-3}$ Pa.

(6) Hot isostatic pressing treatment applied on the sheath to model the composite powder and get the graphene reinforced aluminum alloy composite material, the hot isostatic pressure process was performed at 480° C., 110 Mpa for 2 h.

(7) Remove the sheath after hot isostatic pressure process by linear cutting, lathed bar, etc. Molded the composite by hot extrusion to form graphene reinforced metal bar of Φ12 mm at 440° C.~480° C.

Compared with the existing methods, this invention solves the problem of difficult combination between graphene and metallic matrix. In this process, the amount of graphene can be controlled more precisely and the extrusion process makes graphene further disperse in the matrix and form oriented texture, the intensity of the alloy enhanced significantly. The process is simple and easy to implement mass larger graphene reinforced material preparation.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method of reinforcing a metallic material, comprising:

adding graphene to an alcohol solution;

subjecting the alcohol solution containing graphene to sonication;

mixing an aluminum powder with the alcohol solution containing graphene;

milling the aluminum powder and alcohol solution containing graphene mixture;

drying the aluminum powder and alcohol solution containing graphene mixture to form a composite powder, wherein the composite powder comprises from 0.5 to 2.0 wt. % of the graphene;

subjecting the composite powder to a densification process followed by a hot isostatic pressing treatment to form a composite material, wherein the densification process comprises loading the composite powder into a sheath and oscillating to increase an apparent density to a density that is not lower than 1.6 g/cm$^3$; and molding the composite material by hot extrusion.

2. The method of claim 1, wherein the alcohol solution containing graphene is sonicated for about 30 minutes.

3. The method of claim 1, wherein a ratio of mass of aluminum powder added to a volume of the alcohol containing graphene solution is about 10:1 to 0.5:1.

4. The method of claim 1, wherein the densification process further comprises:

vacuumizing the composite powder in the sheath; and sealing the sheath by welding with the composite powder inside when the pressure reaches $1.0\times10^{-3}$ Pa.

5. The method of claim 1, wherein the hot isostatic pressing treatment is performed at 480° C. and 110 MPa for two hours.

6. The method of claim 1, wherein the molding by hot extrusion occurs at a temperature of 440° C. to 480° C.

* * * * *